United States Patent [19]

Morgan

[11] Patent Number: 5,062,923

[45] Date of Patent: Nov. 5, 1991

[54] ROPE SYSTEM FOR A PAPER MACHINE COATING OR SIZE PRESS SECTION

[75] Inventor: Leslie Morgan, Pendoylan, Great Britain

[73] Assignee: The Wiggins Teape Group Limited, Baskingstoke, England

[21] Appl. No.: 552,849

[22] Filed: Jul. 13, 1990

Related U.S. Application Data

[63] Continuation of Ser. No. 321,314, Mar. 10, 1989, abandoned.

[30] Foreign Application Priority Data

Mar. 11, 1988 [GB] United Kingdom ..... 8805786

[51] Int. Cl.[5] ..... D21F 7/02

[52] U.S. Cl. ..... 162/265; 162/193; 162/255; 34/117; 34/120

[58] Field of Search ..... 162/193, 199, 272, 283, 162/286, 255, 265; 34/117, 120; 226/91

[56] References Cited

U.S. PATENT DOCUMENTS

| | | | |
|---|---|---|---|
| 1,504,727 | 8/1924 | Sheahan . | |
| 1,688,267 | 10/1928 | Cram | 162/193 |
| 1,740,261 | 12/1929 | Page . | |
| 2,716,291 | 8/1955 | Daly, Jr. | 34/120 |
| 2,944,345 | 7/1960 | Faeber . | |
| 3,145,588 | 7/1964 | Phillips . | |
| 4,014,740 | 3/1977 | Koponen et al. | 162/193 |
| 4,610,097 | 9/1986 | Kotitschke et al. | 34/120 |
| 4,728,396 | 3/1988 | Alheid | 162/193 |

FOREIGN PATENT DOCUMENTS

| | | |
|---|---|---|
| 0094631 | 11/1983 | European Pat. Off. . |
| 753958 | 8/1956 | United Kingdom . |
| 1549381 | 8/1979 | United Kingdom . |
| 2133777 | 10/1986 | United Kingdom . |

*Primary Examiner*—Karen M. Hastings

*Attorney, Agent, or Firm*—Burns, Doane, Swecker & Mathis

[57] ABSTRACT

In a papermachine coating or size press section a rope system is provided for feeding the web through the machine either initially or after a break. In an abrasive environment continuously running ropes can lead to excessive wear on the ropes. In the present invention a rope system for a papermachine has means independent of a papermachine for driving the ropes which may be stationary when not in use. The driving capacity of the rope system is such that during simultaneous operation of both the rope system and the coating or size press section, the rope system can operate at speeds greater than the section.

5 Claims, 1 Drawing Sheet

VARIABLE SPEED DRIVE MEANS

ROPE SYSTEM FOR A PAPER MACHINE COATING OR SIZE PRESS SECTION

This application is a continuation of application Ser. No. 07/321,314, filed Mar. 10, 1989, now abandoned.

This invention relates to a papermachine and in particular to a rope system for use on such a machine.

When starting up a papermachine, or after a break in the web it is necessary to be able to feed the paper web through the machine. This is effected by a series of rope systems known as Sheahan ropes, but hereinafter called ropes for convenience, which run outside the edge of the paper web and which can pick up a tail of the paper web and lead it through the papermachine.

The ropes are arranged in a series of separate systems, each carrying the tail through a part of the machine. Each system comprises two ropes which are arranged to come together to pick up and grip the tail and carry it through the appropriate part of the machine, the ropes then parting to release the tail where it can be fed either automatically between the systems or by hand. The ropes in each system are carried around the cylinders and pulleys of the papermachine and are driven thereby, and run continuously with the papermachine while it is in operation. The ropes are normally changed at appropriate service intervals on the papermachine and it has been found that, except in certain circumstances, no particular problems have occurred with continuously running ropes. However in certain parts of the papermachine an abrasive environment may be encountered, such as occurs when a coater section is located at the conventional size press position. If the coating being applied is for example, a clay, it may be deposited on the ropes leading to excessive wear and hence breakage of the ropes. This in turn necessitates a shutdown of the machine while the ropes are replaced. It is an object of the present invention to avoid this drawback.

According to the present invention a rope system for a papermachine has means for driving the ropes which can be rendered inoperative when not required. Preferably the ropes are arranged to be stationary when not required and this avoids wear on the ropes. Preferably also the means for driving the ropes is independent of the papermachine. Moreover the speed at which the ropes can be driven is preferably variable.

In one convenient arrangement the ropes are employed in a coater system embodied in the papermachine. In this case the ropes may also pass round the first cylinder of the after dryer, but do not rotate with it. In this case the ropes may be carried round the said first cylinder by means of a ring bearing, the inner race of which is secured to the cylinder whilst the outer race receives the rope. In this case the cylinder may be covered with a self release coating material such as a Teflon sleeve and is therefore unfelted.

BRIEF DESCRIPTION OF THE DRAWINGS

The invention may be performed in various ways and one specific embodiment will now be described by way of example with reference to the drawings in which.

Figures 1, 2:
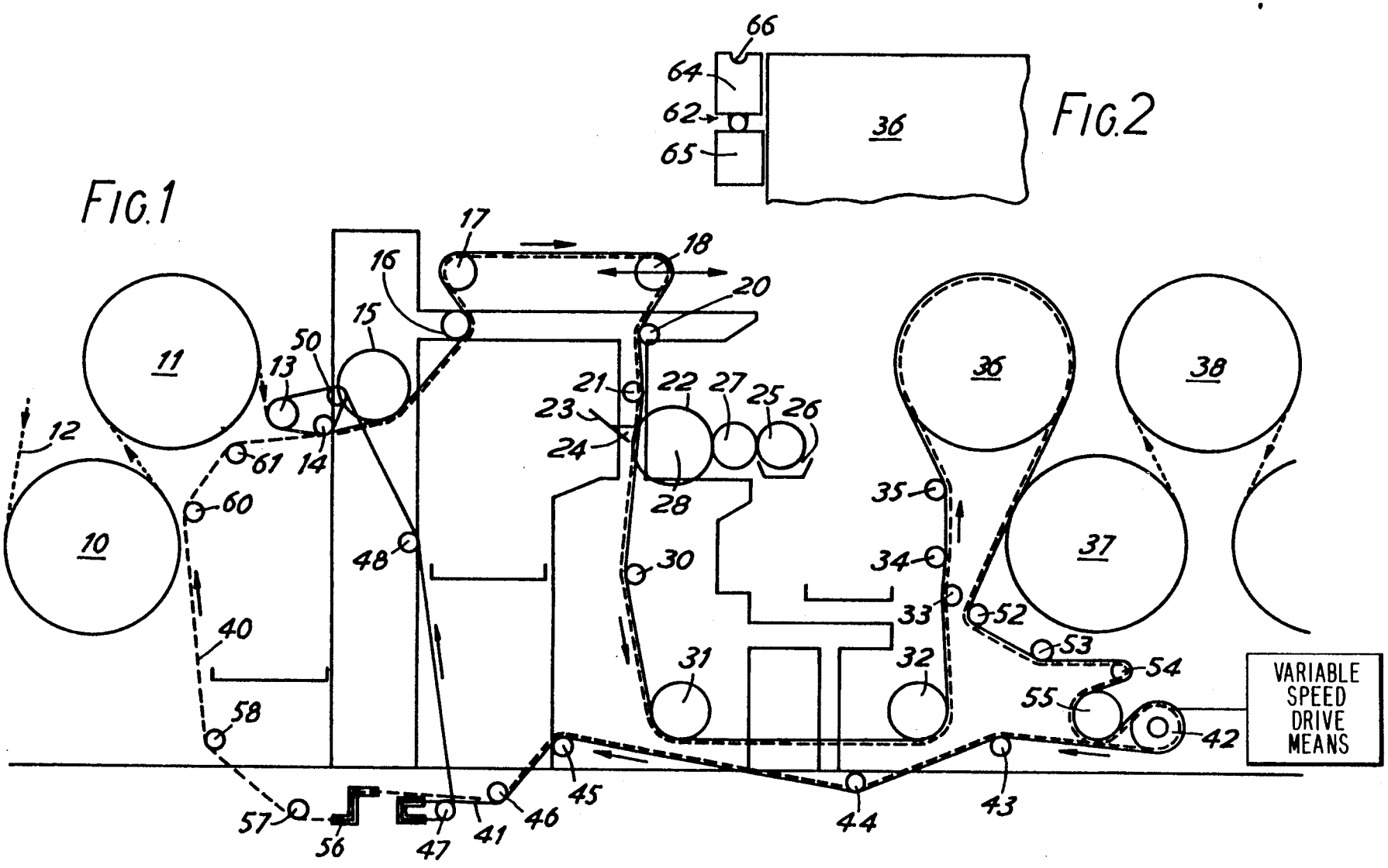
FIG. 1 is a somewhat diagrammatic elevation of a part of a papermachine incorporating the present invention and FIG. 2 is a somewhat diagrammatic elevation showing how the ropes are received on the first after drying cylinder.

In the drawings the left hand end is the end of one drying section of the papermachine and is illustrated by two cylinders 10 and 11.

After leaving cylinder 11 the web travels in to a coater section and which comprises entry guide tension roll 13, from whence it passes to rope pulley 14 and thence to guide rolls 15, 16, 17, 18, 20, 21 and thence in to a coater unit indicated generally at 22. The coater unit is arranged to coat both sides of the paper simultaneously and comprises a bill blade 23 which is supplied with a coating material and which is illustrated at 24, the blade being adjustable in conventional manner to apply the desired thickness of coating.

The other side of the web is coated by means of a roller 25 which obtains the coating from a bath 26 underneath it and which passes it to a contra rotating roller 27 which in turn passes it to roller 28 which applied it to the web.

After coating the web passes to a comber roll 30 further rolls 31, 32, rope pulley 33, comber roll 34 and rope pulley 35 and then on to the first cylinder 36 of the after dryer which will be described in more detail below. It then passes round the second cylinder of the after dryer and hence to cylinder 38 and so on.

The coater unit is provided with an independent rope system which comprises an inside rope shown in chain lines at 40 and an outside rope shown in full lines at 41.

The ropes are driven by means of an electric motor 42 in the direction of the arrow over freely rotatable guide pulleys 43, 44, 45, 46. The inside rope then passes to an inside rope stretcher indicated at 47 from whence it passes via guide pulley 48 to guide pulley 50 and thence around freely rotatable pulleys coincident with rolls 13 and rope pulley 14 and following the paper web in similar manner around rolls 15 through to the point where the web leaves the first cylinder 36 of the drying section. The rope then travels via guide pulleys 52, 53, 54, 55 back to the motor 42.

The outside rope also travels from the motor 42 in the direction of the arrow via pulleys 43 to 46 thence to an outside rope stretcher 56 further guide pulleys 57, 58, 60, 61 and thence meets up with the inside rope at roll 14, where it comes together with rope 40. The ropes part after delivering the tail to the cylinder 37 to release it to enable it to pass round this cylinder, it being picked up by another rope system at this point which is not shown in the drawings.

The first and second cylinders of the after dryer are Teflon sleeved and unfelted.

FIG. 2 shows how the ropes are carried round cylinder 36. A bearing ring 62 is provided on one side and comprises an outer race 64 and an inner race 65. The inner race 65 is secured to the front of the cylinder 36 whilst the outer race is freely rotatable and receives the ropes in groove 66.

The cylinder 36 is unfelted, the web leaving this cylinder to pass on to unfelted cylinder 37 and on to the felted section at cylinder 38 which then carries the web through the after dryer in conventional manner.

When starting up or during feed up after a break the motor 42 is activated and suitable means are provided for regulating the speed of the motor, and hence the speed of the ropes. The ropes can be driven at a speed faster than the papermachine and this is particularly useful in a coater where there tends to be a cascade effect in the web after starting or feeding up which required the cylinders of the after dryer to be varied in speed to take account of this and iron out any slacks which may arise in the web prior to being reeled up. In other words, the drive means for the rope system is structured and arranged to drive the ropes at variable speeds and to provide a driving capacity such that during simultaneous operation of both drive means the drive means of the rope system can operate at speeds greater than the papermachine coating or size press section drive means.

The present invention provides a simple and effective way of avoiding any unnecessary wear on the ropes. Although the rope system has been described in connection with a coater it can be employed in any other part of a papermachine.

I claim:

1. In a papermachine, an on-line coating section or size press section thereof comprising a rope system, wherein the papermachine includes a drive means for driving the coating section or size press section and a drive means for driving the rope system and wherein the drive means for the rope system for the section is independent from the other drive means and is structured and arranged for driving the ropes at variable speeds and to provide a driving capacity such that during simultaneous operation of both drive means the drive means of the rope system can operate at speeds greater than the other drive means.

2. A papermachine according to claim 1, wherein the rope system is employed in the coating section of the machine.

3. A papermachine according to claim 2, further comprising a dryer adjacent to the rope system and means for guiding the ropes near the edge of a first dryer cylinder, said means structured and arranged so that the ropes do not rotate as a result of said dryer cylinder rotating.

4. A papermachine according to claim 3, wherein the ropes are carried around the first dryer cylinder by means of a ring bearing having an inner race and an outer race, the inner race being secured to the cylinder and the outer race receiving the ropes.

5. A papermachine according to claim 4, wherein the dryer cylinder is covered with a self-release coating and is unfelted.

* * * * *